US009211745B2

(12) United States Patent
Kubo

(10) Patent No.: US 9,211,745 B2
(45) Date of Patent: Dec. 15, 2015

(54) IMAGE ERASING APPARATUS AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Tomoaki Kubo, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/267,980

(22) Filed: May 2, 2014

(65) Prior Publication Data

US 2014/0240435 A1 Aug. 28, 2014

Related U.S. Application Data

(63) Continuation of application No. 13/941,740, filed on Jul. 15, 2013, now Pat. No. 8,760,480.

(30) Foreign Application Priority Data

Jan. 8, 2013 (JP) ..... 2013-001280

(51) Int. Cl.
*B41M 7/00* (2006.01)
*B41J 29/36* (2006.01)
*B41J 11/00* (2006.01)

(52) U.S. Cl.
CPC ..... *B41J 29/36* (2013.01); *B41J 11/002* (2013.01); *B41M 7/0009* (2013.01)

(58) Field of Classification Search
USPC ..... 347/179, 212
See application file for complete search history.

(56) References Cited

U.S. PATENT DOCUMENTS

| | | | |
|---|---|---|---|
| 5,444,518 | A | 8/1995 | Hashiguchi et al. |
| 8,331,807 | B2 | 12/2012 | Homma et al. |
| 8,422,892 | B2 | 4/2013 | Yoshida et al. |
| 8,554,091 | B2 | 10/2013 | Homma et al. |

(Continued)

FOREIGN PATENT DOCUMENTS

| | | |
|---|---|---|
| JP | 06-070134 | 3/1994 |
| JP | 2005-128046 | 5/2005 |

(Continued)

OTHER PUBLICATIONS

Computer-generated translation of JP 2012-118526, published on Jun. 2012.*

(Continued)

*Primary Examiner* — Huan Tran
(74) *Attorney, Agent, or Firm* — Amin, Turocy & Watson, LLP

(57) ABSTRACT

According to an embodiment, an image erasing apparatus includes an erasing unit, an input unit, and a control unit. The erasing unit erases an image formed on a recording medium. The input unit inputs identification data which identifies an apparatus which forms the image on the recording medium. The control unit controls an operation of the erasing unit based on the identification data input by the input unit. According to another embodiment, an image forming apparatus includes an image forming unit which forms an image on a recording medium, the erasing unit, the input unit, and the control unit.

5 Claims, 7 Drawing Sheets

(56) References Cited

U.S. PATENT DOCUMENTS

| | | | | |
|---|---|---|---|---|
| 8,760,480 | B1 * | 6/2014 | Kubo | 347/179 |
| 2005/0141906 | A1 | 6/2005 | Murakami | |
| 2011/0274445 | A1 | 11/2011 | Kabai et al. | |
| 2012/0038958 | A1 | 2/2012 | Iguchi et al. | |
| 2013/0258379 | A1 | 10/2013 | Yoshida et al. | |
| 2014/0003826 | A1 | 1/2014 | Homma et al. | |

FOREIGN PATENT DOCUMENTS

| | | |
|---|---|---|
| JP | 2012-037891 | 2/2012 |
| JP | 2012-118526 | 6/2012 |

OTHER PUBLICATIONS

Japanese Office Action for Japanese Patent Application No. 2013-001280 mailed Nov. 18, 2014.

Japanese Office Action for Japanese Patent Application No. 2013-001280 mailed Jun. 23, 2015.

* cited by examiner

210A

| MANUFACTURER'S NAME | MODEL NUMBER | ERASABIRITY | ERASING TEPERATURE |
|---|---|---|---|
| △ CORPORATION | 1 2 3 4 5 6 | ERASABLE | 6 0℃ |
| : | : | : | |

Fig.3

IMAGE ERASING APPARATUS AND IMAGE FORMING APPARATUS

CROSS-REFERENCE TO RELATED APPLICATION

This application is a Continuation of application Ser. No. 13/941,740 filed Jul. 15, 2013, the entire contents of which are incorporated herein by reference.

This application is based upon and claims the benefit of priority from the prior Japanese Patent Application No. 2013-1280, filed on Jan. 8, 2013, the entire contents of which are incorporated herein by reference.

FIELD

Embodiments described herein relate generally to an image erasing apparatus which erases an image formed on a recording medium and an image forming apparatus which has an erasing function.

BACKGROUND

An image erasing apparatus which erases an image of a recording medium, for example, a sheet formed by an erasable coloring material for the purpose of resource saving and cost reduction is practically used.

A color of the erasable coloring material disappears or becomes transparent by erasing processing, for example, heating processing. Therefore, the image erasing apparatus has an erasing unit which heats the recording medium. The erasing unit heats the recording medium to erase the image of the recording medium. The heated recording medium is conveyed to an accommodating unit which accommodates the recording medium via a conveyance path.

Meanwhile, the recording medium on which an image is formed by various coloring materials is supplied to the image erasing apparatus by a user in order to erase the image. Therefore, in case of some types of coloring materials, the image of the recording medium may not be erased by the image erasing apparatus. Further, in case of some types of coloring materials, the coloring material is eluted by the heating processing and the eluted coloring material may contaminate the inside of the image erasing apparatus. The contamination is attached to the recording medium again or shortens the lifespan of the image erasing apparatus.

BRIEF DESCRIPTION OF THE DRAWINGS

FIG. 3 is a diagram illustrating a data structure of a control table of the image erasing apparatus according to the first embodiment;

DETAILED DESCRIPTION

According to an embodiment, an image erasing apparatus which erases an image formed on a recording medium using various coloring materials is disclosed. The image erasing apparatus includes an erasing unit, an input unit, and a control unit. The erasing unit erases an image formed on a recording medium. The input unit inputs identification data which identifies a device which forms the image on the recording medium. The control unit controls an operation of the erasing unit based on the identification data input by the input unit.

According to another embodiment, an image forming apparatus which erases an image formed on a recording medium and forms an image on the recording medium is disclosed. The image forming apparatus includes an image forming unit, an erasing unit, an input unit, and a control unit. The image forming unit forms an image on a recording medium. The erasing unit erases an image formed on a recording medium. The input unit inputs identification data which identifies a device which forms the image on a recording medium from which an image is erased. The control unit controls an operation of the erasing unit based on the identification data input by the input unit.

Figure 1:
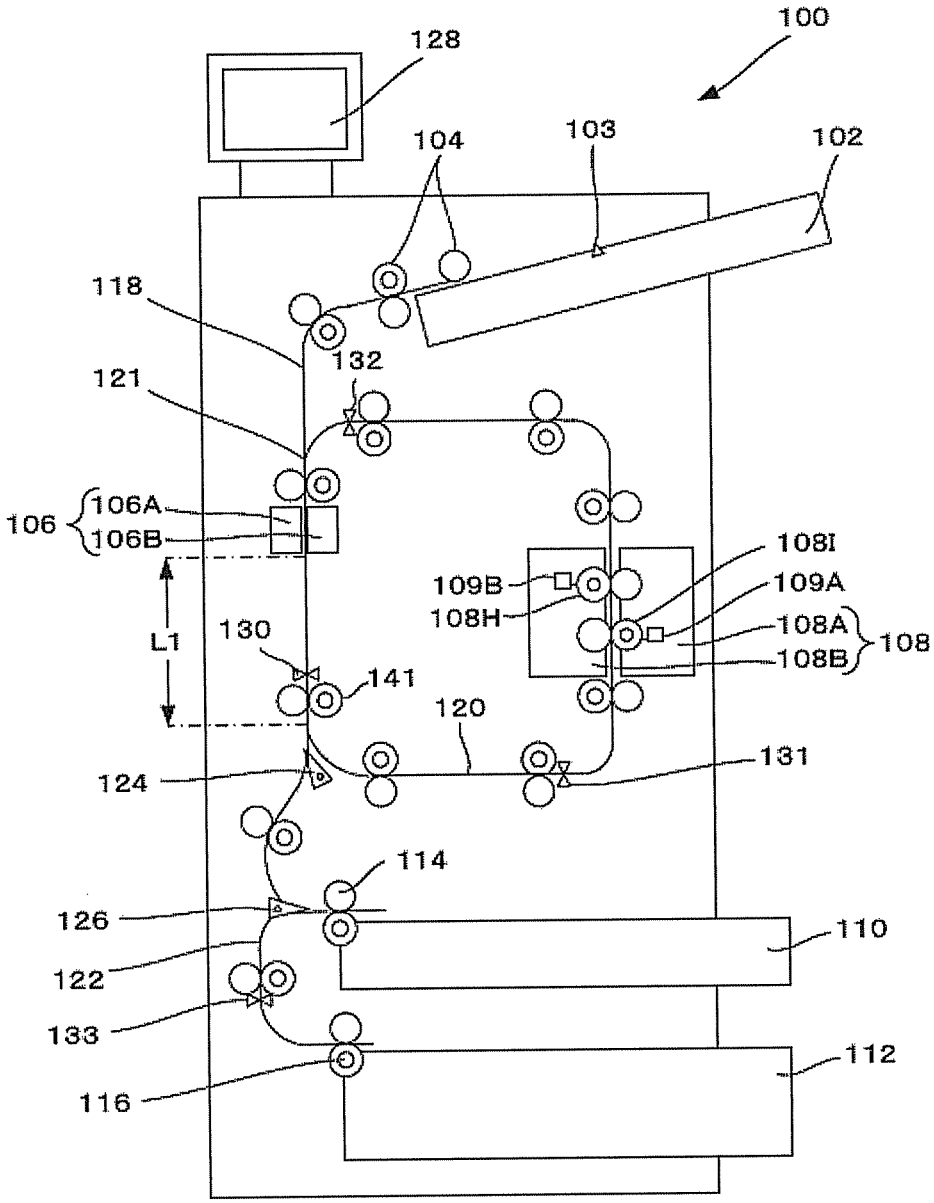
FIG. 1 is a cross-sectional view illustrating an image erasing apparatus according to a first embodiment.

Hereinafter, embodiments will be described further with reference to the drawings. In the drawings, the same reference numerals denote the same or similar parts. FIG. 1 is a cross-sectional view illustrating an image erasing apparatus according to a first embodiment. The image erasing apparatus 100 erases an image formed on a recording medium, for example, a sheet, using a coloring material such as an erasable toner or an erasable ink.

As illustrated in FIG. 1, the image erasing apparatus 100 includes a sheet feeding tray 102, a sheet feeding member 104, an input unit 106, an erasing unit 108, a reuse tray 110, a reject tray 112, discharging members 114, 116, a first conveyance path 118, a second conveyance path 120, a third conveyance path 122, a first diverging member 124, a second diverging member 126, and a operation unit 128.

The sheet feeding tray 102 includes a loading surface on which a sheet from which the image is erased so as to be reused is loaded. In the sheet feeding tray 102, various sizes of sheets, such as A4, A3, or B5, are loaded. The sheet loaded in the sheet feeding tray 102 is a sheet on which an image is formed by coloring materials which are erased by erasing processing, for example, by being heated at a predetermined temperature or higher (coloring materials whose colors becomes transparent by being heated). The sheet feeding tray 102 has a sheet presence detecting sensor 103 which detects whether there is a sheet loaded on the loading surface. The sheet presence detecting sensor 103, for example, may include a micro sensor or a micro actuator.

The sheet feeding member 104 includes a pick-up roller, a sheet feeding roller, and a separation roller disposed to be opposite to the sheet feeding roller. The sheet feeding member 104 feeds the sheet loaded on the sheet feeding tray 102 to the first conveyance path 118 of the image erasing apparatus 100 one by one. The first conveyance path 118 forms a conveyance path from the sheet feeding tray 102 to the reuse tray 110. The first conveyance path 118 conveys the sheet fed from the sheet feeding tray 102 to the reuse tray 110 via the input unit 106.

Figure 2:
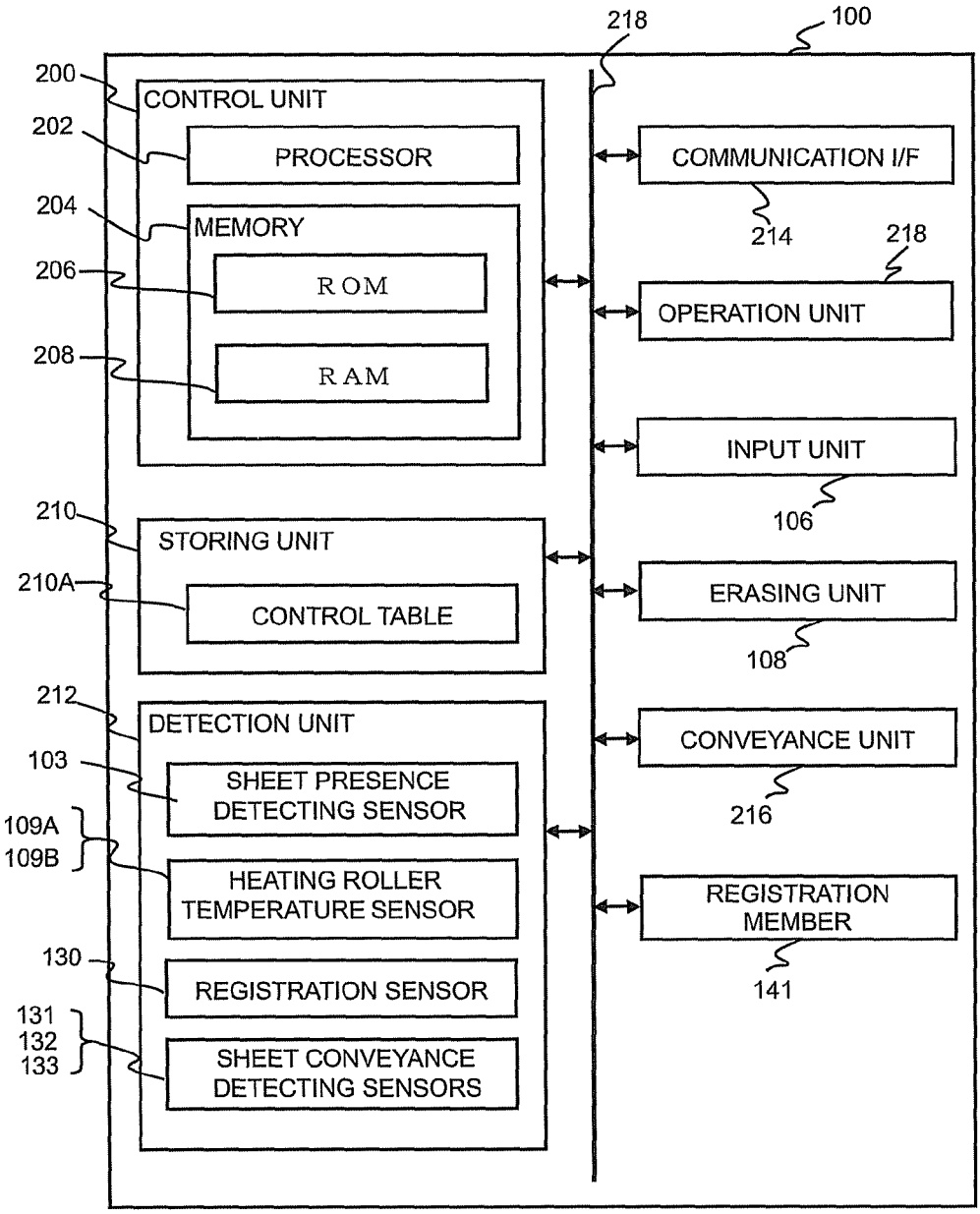
FIG. 2 is a block diagram illustrating a hardware configuration of the image erasing apparatus according to the first embodiment.

The input unit 106 is disposed along the first conveyance path 118 at a downstream of a sheet conveyance direction further than the sheet feeding tray 102. The input unit 106 has, for example, a CCD (charge coupled device) scanner which is a reading unit or a CMOS sensor. In the first embodiment, the input unit 106 inputs data of images which are formed on a first surface and a second surface of the conveyed sheet to a storing unit 210 which is illustrated in FIG. 2.

Specifically, the input unit 106 has a first reading unit 106A and a second reading unit 106B which are disposed along the first conveyance path 118 disposed between the first reading unit 106A and the second reading unit 106B. The input unit 106 scans both sides of a sheet which is being conveyed to read the image. A position where the first reading unit 106A and the second reading unit 106B read the image of the sheet is referred to as a reading position. The image read by the first reading unit 106A and the second reading unit 106B is stored in the storing unit 210. For example, a control unit 200 which will be described below digitizes the image of the sheet read by the first reading unit 106A and the second reading unit 106B before erasing the image and stores the image in the storing unit 210. By storing the image, if the user needs the erased image data, the user may obtain the image data from the storing unit 210. Further, as will be described below, the control unit 200 determines whether the sheet which is being conveyed is a sheet on which an erasable image is formed or a reusable sheet based on the image read by the first reading unit 106A and the second reading unit 106B.

The image erasing apparatus 100 includes the first diverging member 124 as a switching member at a downstream of the input unit 106. The first diverging member 124 switches the conveyance direction of the sheet. The first diverging member 124 conveys the sheet which is being conveyed in the first conveyance path 118 to the second conveyance path 120 or the reuse tray 110. The second conveyance path 120 is diverged from the first conveyance path 118 at a diverging point where the first diverging member 124 is disposed. The second conveyance path 120 which is diverged from the diverging point conveys the sheet to the erasing unit 108. The second conveyance path 120 meets the first conveyance path 118 at a meeting point 121 between the sheet feeding tray 102 and the input unit 106 at an upstream of the sheet conveyance direction further than the input unit 106. Therefore, the second conveyance path 120 may convey the sheet which is conveyed from the input unit 106 to the input unit 106 again, via the erasing unit 108.

In the image erasing apparatus 100, the control unit 200 controls the first diverging member 124 to convey the sheet fed from the sheet feeding tray 102 to the input unit 106, the erasing unit 108, and the input unit 106 in this order. The first conveyance path 118 has the second diverging member 126 at a downstream of the first diverging member 124. The second diverging member 126 guides the sheet conveyed from the first diverging member 124 to the reuse tray 110 or the third conveyance path 122. The third conveyance path 122 conveys the sheet to the reject tray 112.

The erasing unit 108 erases the image of the sheet which is being conveyed. The erasing unit 108, for example, erases a color of the image formed on the sheet (the color of the coloring material becomes transparent) by heating the sheet at a predetermined erasing temperature or higher in a state which the erasing unit 108 is in contact with the sheet which is being conveyed. The erasing temperature is a temperature where the color of the coloring material disappears by heating the coloring material and varies depending on a kind of the coloring material. The erasing unit 108 includes a first erasing unit 108A which erases the image of the first surface of the sheet and a second erasing unit 108B which erases the image of the second surface.

The first erasing unit 108A includes a first heating roller 108H which has a heater, a first heating roller temperature sensor 109A which detects a temperature of the first heating roller 108H, and a first driven roller. The first heating roller 108H and the first driven roller are disposed so as to be opposite to each other with the second conveyance path 120 therebetween. The second erasing unit 108B includes a second heating roller 108I which has a heater, a second heating roller temperature sensor 109B which detects a temperature of the second heating roller 108I, and a second driven roller. Hereinafter, the first heating roller temperature sensor 109A and the second heating roller temperature sensor 109B are referred to as heating roller temperature sensors. The second heating roller 108I and the second driven roller are disposed so as to be opposite to each other with the second conveyance path therebetween. The first heating roller 108H and the second heating roller 108I are disposed to be opposite to each other with the second conveyance path therebetween. The first heating roller 108H abuts against the sheet from one side of the sheet to heat the image of the sheet. The second heating roller 108I abuts against the sheet from the other side of the sheet to heat the image of the sheet. the erasing unit 108 erases the images on both sides of the sheet during one time conveyance.

The image erasing apparatus 100 includes the operation unit 128 disposed at the top of the main body. The operation unit 128 has a touch panel type display unit and various operation keys. The operation keys, for example, include a numerical keypad, a stop key, and a start key. The user operates the operation unit 128 to instruct the function of the image erasing apparatus 100, such as starting of the erasing process or reading of the image of the sheet to be erased. The operation unit 128 receives the operation by the user to output the operating signal to the control unit 200.

The display unit of the operation unit 128 displays setting information of the image erasing apparatus 100, an operation status, log information, and a message to the user. The operation unit 128 is not limited to being disposed in the main body of the image erasing apparatus 100. The operation unit 128 may be an external device connected to the image erasing apparatus 100, for example, via the network. Further, the operation unit 128 may be an independent device from the main body of the image erasing apparatus and may be configured to operate the image erasing apparatus 100 via wired or wireless communication. The operation unit 128 of the first embodiment may receive operation of the image erasing apparatus 100 by the user and browse the information of the image erasing apparatus 100.

The discharging members 114 and 116 discharge the sheet to the reuse tray 110 and the reject tray 112 which are vertically disposed in a line below the main body. For example, the reuse tray 110 accommodates a sheet from which the image is erased to be reusable. The reject tray 112 accommodates a sheet which is determined as being non-reusable by the control unit 200.

The conveyance path of the sheet is changed based on a processing mode which is performed by the image erasing apparatus 100. The image erasing apparatus 100 has first to fifth processing modes. In a first processing mode, the image erasing apparatus 100 erases the image by the erasing unit 108 without reading the image by the input unit 106 before and after erasing the image of the sheet. In a second processing mode, the image erasing apparatus 100 reads the image using the input unit 106 before erasing the image of the sheet and erases the image by the erasing unit 108 after reading the image. In a third processing mode, the image erasing apparatus 100 erases the image by the erasing unit 108 without reading the image by the input unit 106 before erasing the image of the sheet. After erasing the image, the image erasing apparatus 100 reads the image of the sheet by the input unit 106 and determines whether the sheet is reusable, and distinguishes a reusable sheet from a non-reusable sheet.

In a fourth processing mode, the image erasing apparatus 100 reads the image of the sheet by the input unit 106 before erasing the image of the sheet and erases the image by the erasing unit 108 after reading the image. The image erasing apparatus 100 further discriminates the reusable sheet and the non-reusable sheet by reading the image by the input unit 106 again after erasing the image. In a fifth processing mode, the image erasing apparatus 100 reads the image by the input unit 106 without erasing the image. The above processing modes may be selected by the operation of the user in the operation unit 128. The processing modes may be selected not only by the operation unit 128 of the image erasing apparatus 100, but also by a user via an external terminal.

The image erasing apparatus 100 includes a plurality of sheet conveyance detecting sensors 131, 132, and 133 which detect the sheet conveyed to the first to third conveyance paths 118, 120, and 122. The image erasing apparatus 100 includes a registration member 141 at a downstream of the sheet conveyance direction further than the input unit 106 of the first conveyance path 118 and an upstream of the sheet conveyance direction further than the second diverging member 126. The registration member 141 includes a drive roller and a driven roller which are disposed so as to be opposite to each other with the first conveyance path 118 therebetween. The registration member 141 has, for example, a stepping motor which drives the drive roller.

The image erasing apparatus 100 includes a registration sensor 130 provided at an upstream of the sheet conveyance direction of the first conveyance path 118 of the registration member 141. The registration sensor 130 detects that the sheet enters the registration member 141. The control unit 200 drives the registration member 141 and makes the registration member 141 grasp the sheet for a predetermined rotating step of the stepping motor after the sheet turns on the registration sensor 130. As will be described below, the control unit 200 determines whether the image is erasable from the sheet based on the reading result by the input unit 106. During a time T1 when the determination is performed, the control unit 200 suspends the sheet by the registration member 141. Specifically, when the control unit 200 determines that the sheet enters the registration member 141 to be grasped based on the output of the registration sensor 130, the control unit 200 stops the rotation of the drive roller of the registration member 141. A length L1 from the position of the input unit 106 to a position of a leading edge of the sheet which is suspended by the registration member 141 is larger than a maximum length of a sheet which may be processed by the image erasing apparatus 100. In case that the length L1 is a length where a sheet conveying time is sufficiently longer than the time T1, the image erasing apparatus 100 may not have the registration member 141.

FIG. 2 is a block diagram illustrating a hardware configuration of the image erasing apparatus 100. As illustrated in FIG. 2, the image erasing apparatus 100 includes the control unit 200, the storing unit 210, a detecting unit 212, a communication interface (communication I/F) 214, a conveyance unit 216, the input unit 106, the erasing unit 108, the operation unit 128, and the registration member 141.

The control unit 200 includes a processor 202 such as a CPU (central Processing unit) and a memory 204. The control unit 200 controls the input unit 106, the erasing unit 108, the operation unit 128, the conveyance unit 216, and the registration member 141. The memory 204 is, for example, a semiconductor memory and includes a ROM (read only memory) 206 which stores various control programs and a RAM (random access memory) 208 which provides a temporal working area to the processor 202.

For example, the ROM 206 stores a printing ratio of the sheet as a threshold value for determining whether the sheet is reusable. The ROM 206 further stores a concentration threshold value for determining whether a color of the image of the sheet disappears. The RAM 208 may temporally store data of the image read by the input unit 106. Respective components of the image erasing apparatus 100 are connected via a bus 218.

The control unit 200 controls components such as the input unit 106 and the erasing unit 108, for example, in accordance with the first to fifth processing modes set by the operation unit 128. For example, in case that the operation unit 128 receives the selection of the first processing mode by the user, the operation unit 128 outputs a operation signal corresponding to the first processing mode to the control unit 200. The control unit 200 conveys the sheet to the erasing unit 108 via the first conveyance path 118 and the second conveyance path 120 and allows the erasing unit 108 to erase the image of the sheet. After erasing the image, the control unit 200 conveys the sheet to the reuse tray 110 via the second conveyance path 120 and the first conveyance path 118. In this case, before and after erasing the image, the input unit 106 does not read the image.

In case that the operation unit 128 receives the selection of the second processing mode by the user, the control unit 200 allows the input unit 106 to read the image of the sheet before conveying the sheet to the erasing unit 108. The control unit 200 stores the data of the image which is read by the input unit 106 in the storing unit 210. Further, the control unit 200 determines a conveyance path of the sheet based on the data of the read image. Specifically, the control unit 200 determines whether the printing ratio of the image in the sheet read by the input unit 106 is larger than the threshold value. Further, the control unit 200 may determine whether prohibition data (for example, confidential data) which indicates, for example, erasing prohibition is included in the read image data, before erasing the image. In case that the printing ratio of the image is larger than the threshold value, or the prohibition data is included in the image data, the control unit 200 conveys the sheet to the reject tray 112 via the first conveyance path 118 and the third conveyance path 122 without erasing the image by the erasing unit 108.

Meanwhile, in case that the printing ratio of the image is not larger than the threshold value and the prohibition data is not included in the image data, the control unit 200 conveys the sheet to the erasing unit 108 after reading the image of the sheet by the input unit 106 and allows the erasing unit 108 to erase the image. After erasing the image, the control unit 200 conveys the sheet to the reuse tray 110 via the second conveyance path 120 and the first conveyance path 118. In this case, after erasing the image, the input unit 106 does not read the image of the sheet.

In case that the operation unit 128 receives the selection of the third processing mode by the user, the control unit 200 conveys the sheet to the erasing unit 108 via the first conveyance path 118 and the second conveyance path 120 and allows the erasing unit 108 to erase the image of the sheet. In this case, before erasing the image, the input unit 106 does not read the image. After erasing the image, the control unit 200 determines the conveyance path of the sheet based on the data of the image read by the input unit 106. Specifically, the control unit 200 determines whether the sheet is reusable based on the data of the image read by the input unit 106. The determination of whether the sheet is reusable includes determination of whether there is a remaining image on the sheet without disappearing.

Specifically, the control unit 200 determines whether a concentration of the image in the sheet read by the input unit 106 is larger than the concentration threshold value. In case that the concentration of the image is larger than the threshold value, the control unit 200 determines that there is the remaining image after being erased and the sheet is not reusable. In case that the concentration of the image is not larger than the threshold value, the control unit 200 determines that there is no remaining image after being erased and the sheet is reusable. Further, the determination of whether the sheet is reusable may include determination of a status such as presence of bending of a sheet, a depth of a wrinkle, or formation of hole. In case that the control unit 200 determines that the sheet is not reusable, the control unit 200 conveys the sheet to the reject tray 112 via the first conveyance path 118 and the third conveyance path 122. Meanwhile, in case that the control unit 200 determines that the sheet is reusable, the control unit 200 conveys the sheet to the reuse tray 110 via the first conveyance path 118.

In case that the operation unit 128 receives the selection of the fourth processing mode by the user, the control unit 200 allows the input unit 106 to read the image before erasing the image. The control unit 200 stores the data of the read image in the storing unit 210 and determines the conveyance path of the sheet based on the data of the read image, which is similar to the second processing mode. After erasing the image, the control unit 200 further allows the input unit 106 to read the image. The control unit 200 further determines a conveyance path of the sheet based on the data of the read image, which is similar to the third processing mode.

In case that the operation unit 128 receives the selection of the fifth processing mode by the user, the control unit 200 allows the input unit 106 to read the image. The control unit 200 stores the data of the image which is read by the input unit 106 in the storing unit 210. After reading the image, the control unit 200 conveys the sheet to the reject tray 112 via the first conveyance path 118 and the third conveyance path 122.

Further, in the first embodiment, the control unit 200 identifies an image forming apparatus which forms the image on the sheet. The control unit 200 determines whether the image is erasable by the erasing unit 108, based on the identification result. In case that the image is erasable by the erasing unit 108, the control unit 200 allows the erasing unit 108 to operate at an erasing temperature which is the erasing process condition corresponding to the identified image forming apparatus. In case that the image is not erasable by the erasing unit 108, the control unit 200 conveys the sheet to the reject tray 112 via the first conveyance path 118 and the third conveyance path 122.

The control unit 200 identifies the image forming apparatus based on the data of the image read by the input unit 106, before erasing the image, for example, the second processing mode and the fourth processing mode. Identification date for identifying the image forming apparatus is added to the image formed on the sheet. The identification data is data specific to the image forming apparatus, for example, a manufacturer's name of the device, a model number, or a manufacturing number. The identification data is added to the image of the sheet as a specific pattern which is formed on the sheet using a color which is inconspicuous by the human eye, for example, a yellow coloring material. The specific pattern may be added to the image of the sheet using a known technique which is disclosed, for example, in Japanese Patent No. 3247446. The specific pattern may be a character, a coded image, or a barcode. The control unit 200 detects the specific pattern included in the data of the image read by the input unit 106 to recognize the identification data that identifies the image forming apparatus. The control unit 200 determines whether the image is erasable by the erasing unit 108 and the erasing process condition using the recognized identification data and a control table 210A which will be described below.

The control unit 200 further controls the components in the device based on a signal from the detecting unit 212. The detecting unit 212 includes a sheet presence detecting sensor 103, sheet conveyance detecting sensors 131, 132, and 133, a registration sensor 130, and the heating roller temperature sensors 109A and 109B. The control unit 200 determines whether there is a sheet of the sheet feeding tray 102 based on a signal from the sheet presence detecting sensor 103. The control unit 200 detects temperatures of the first heating roller 108H and the second heating roller 108I using the heating roller temperature sensors 109A and 109B. The control unit 200 controls the temperatures of the first heating roller 108H and the second heating roller 108I to be a predetermined erasing temperature which is the erasing process condition, based on the detection result. The control unit 200 determines a position of the sheet in the first to third conveyance paths 118, 120, and 122 using the sheet conveyance detecting sensors 131, 132, and 133 and the registration sensor 130.

The storing unit 210 stores the image read by the input unit 106. Further, the storing unit 210 stores the number of sheets which are processed by the image erasing apparatus 100. As the storing unit 210, for example, a magnetic storing device such as a hard disk drive, or an optical storing device, or a semiconductor storing device such as a flash memory, or an arbitrary combination thereof may be used. The storing unit 210, further, stores the control table 210A which will be described below. The image erasing apparatus 100 includes the communication I/F 214 which is an interface connecting to external equipment.

The conveyance unit 216 includes a plurality of conveyance rollers which are disposed in the first conveyance path 118, the second conveyance path 120, the third conveyance path 122 and a conveyance motor which drives the conveyance rollers. The control unit 200 controls the driving of the conveyance motor of the conveyance unit 216 to control a conveyance speed of the sheet. A speed of the sheet which is conveyed to the input unit 106 to read the image of the sheet is considered as a reading speed and a speed of the sheet which is conveyed to the erasing unit 108 to erase the color of the image of the sheet is considered as an erasing speed.

FIG. 3 is a view illustrating a data structure of the control table 210A. The control table 210A stores data specific to a plurality of image forming apparatuses and data for controlling the erasing operation of the erasing unit 108 so as to be associated with the specific data. The specific data is data which specifies the image forming apparatus, for example, data such as a manufacturer's name of the device, a model number, or a manufacturing number. data for controlling the erasing operation of the erasing unit 108 refers to erasability data indicating whether the image of the sheet formed by the image forming apparatus specified by the specific data is erasable by the erasing unit 108 and data on the erasing temperature which is the erasing process condition of the erasing unit 108 when the image is erasable.

As illustrated in FIG. 3, the control table 210A according to the first embodiment stores the manufacturer's name and the model number as data specific to the image forming apparatus and "erasability" data and "erasing temperature" data as data that controls the erasing operation of the erasing unit 108 so as to be associated with the specific data. For example, data of a first row of the control table 210A of FIG. 3 indicates that the image formed by the image forming apparatus whose manufacturer's name is "Δ corporation" and model number is "123456" is erasable (the erasability data is "erasable") and the erasing temperature of the erasing unit 108 is 60° C. (data of the erasing temperature is "60° C.").

Figure 4:
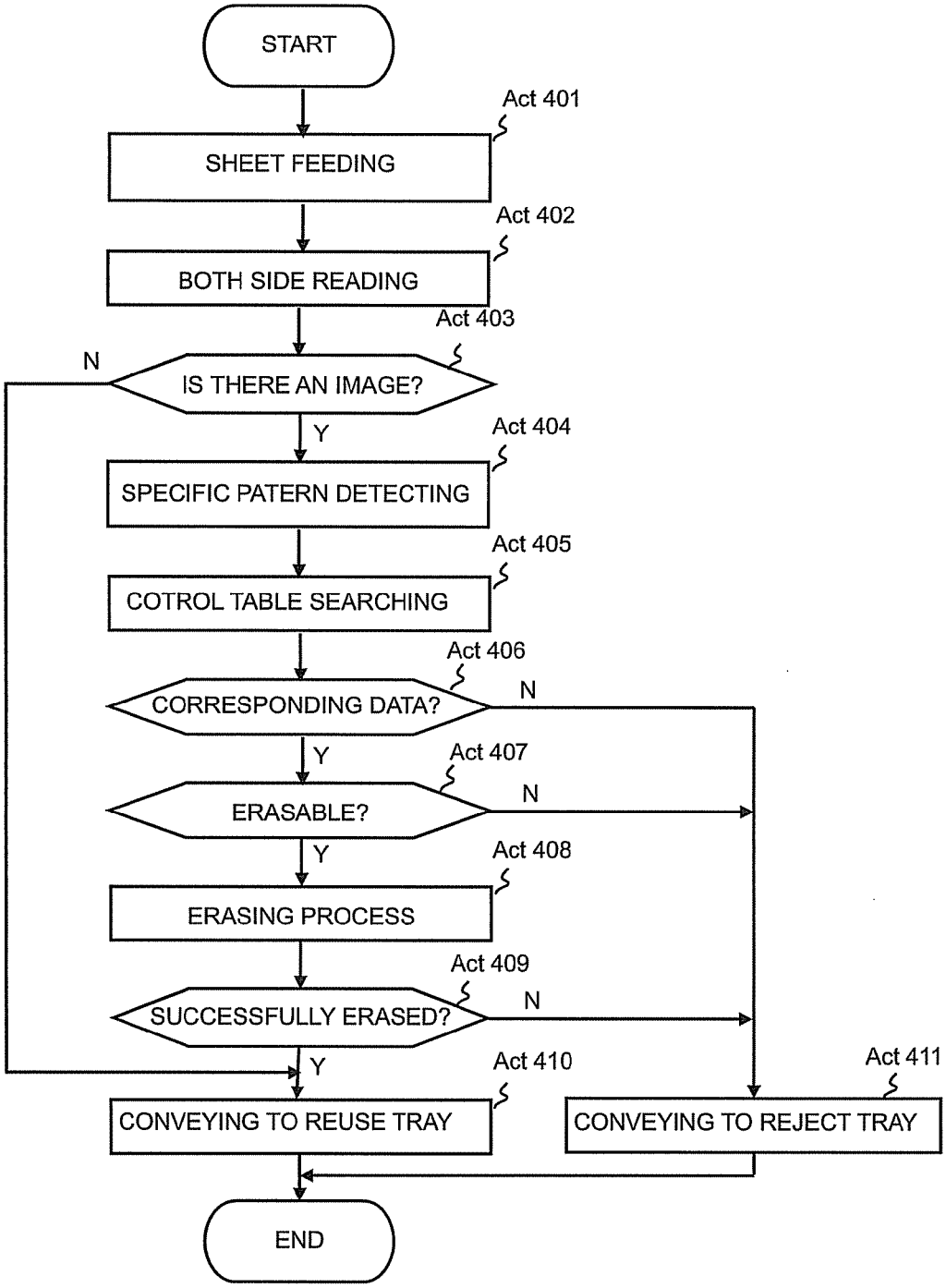
FIG. 4 is a flowchart illustrating an operation of the image erasing apparatus according to the first embodiment.

FIG. 4 is a flowchart illustrating an operation of the image erasing apparatus 100. As illustrated in FIG. 4, the image erasing apparatus 100 identifies the image forming apparatus which forms the image on the sheet and erases the image of the sheet using the identification result and the control table. For example, in case that the sheet presence detecting sensor 103 detects that the sheet is loaded on the sheet feeding tray 102 and the operation unit 128 receives the selection of the fourth processing mode by the user and operation of the start key, the image erasing apparatus 100 feeds the sheet from the sheet feeding tray 102 in Act 401.

In Act 402, the control unit 200 allows the input unit 106 to read the image on both sides of the sheet to store the input image data in the storing unit 210. In Act 403, the control unit 200 determines whether there is an image of the sheet, based on the input image data. In case that the control unit 200 determines that there is an image on the sheet, the operation of the image erasing apparatus 100 proceeds to ACT 404. In case that the control unit 200 determines that there is no image on the sheet, the operation of the image erasing apparatus 100 proceeds to Act 410.

In Act 404, the control unit 200 detects the specific pattern from the image data stored in the storing unit 210 to recognize the identification data. In Act 405, the control unit 200 searches for the recognized identification data from the control table 210A. In Act 406, the control unit 200 determines whether data corresponding to the recognized identification data (corresponding specific data) is present in the control table 210A as a search result. In case that the control unit 200 determines that the specific data corresponding to the recognized identification data is present in the control table 210A, the operation of the image erasing apparatus 100 proceeds to Act 407. In case that the control unit 200 determines that the specific data corresponding to the recognized identification data is not present in the control table 210A, the image is not erasable so that the operation of the image erasing apparatus 100 proceeds to Act 411.

In Act 407, the control unit 200 reads the data of "erasability" associated with the corresponding specific data from the control table 210A and determines whether the image of the corresponding sheet is erasable, based on the data of "erasability". In case that the control unit 200 determines that the image of the sheet is erasable, the operation of the image erasing apparatus 100 proceeds to Act 408. In case that the control unit 200 determines that the image of the sheet is not erasable, the operation of the image erasing apparatus 100 proceeds to Act 411.

In Act 408, the image erasing apparatus 100 conveys the sheet to the erasing unit 108. The control unit 200 reads the data of the erasing temperature associated with the corresponding specific data from the control table 210A and controls the temperature of the erasing unit 108 based on the data of the erasing temperature to erase the image of the sheet. In Act 409, the control unit 200 conveys the sheet which is subjected to the erasing process to the input unit 106 and determines whether the image is successfully erased. In case that the control unit 200 determines that the image is successfully erased (there is no remaining image after being erased), the operation of the image erasing apparatus 100 proceeds to Act 410. In case that the control unit 200 determines that the image is not successfully erased (there is a remaining image after being erased), the operation of the image erasing apparatus 100 proceeds to Act 411. In Act 410, the image erasing apparatus 100 conveys the sheet to the reuse tray 110. In Act 411, the image erasing apparatus 100 conveys the sheet on which the image is not erasable or the image is not successfully erased to the reject tray 112.

The above-described operation of the image erasing apparatus 100 is performed when the fourth processing mode is selected by the user in the operation unit 128. However, for example, in case that the first processing mode is selected by the user, the operation of the image erasing apparatus 100 proceeds to Act 408 ignoring Act 402 to Act 407. In Act 408, the control unit 200 controls the temperature of the erasing unit 108 to erase the image of the sheet based on a predetermined erasing temperature. After erasing the image, the operation of the image erasing apparatus 100 proceeds to Act 410, ignoring Act 409.

Further, in case the second processing mode is selected by the user, the operation of the image erasing apparatus 100 proceeds to Act 411 ignoring Act 409 after erasing the image in Act 408. In addition, in case that the third processing mode is selected by the user, the operation of the image erasing apparatus 100 proceeds to Act 408 ignoring Act 402 to Act 407. In Act 408, the control unit 200 controls the temperature of the erasing unit 108 to erase the image of the sheet based on the predetermined temperature. Further, in case that the fifth processing mode is selected by the user, the operation of the image erasing apparatus 100 proceeds to Act 411 ignoring Act 403 to Act 409 after reading the image on both sides of the sheet in Act 402.

As described above, according to the image erasing apparatus 100 of the first embodiment, in the second processing mode and the fourth processing mode, the image forming apparatus which forms the image on the sheet is recognized to determine whether the image is erasable by the erasing unit 108. Further, in case that the image is erasable by the erasing unit 108, the erasing unit 108 operates under an erasing condition which is erasing temperature corresponding to the recognized image forming apparatus. Further, in case that the image is not erasable by the erasing unit 108, the erasing unit 108 does not operate and the sheet is discharged to the reject tray 112. Accordingly, according to the image erasing apparatus 100 of the first embodiment, the erasing process may be performed on a sheet on which an image is formed by various coloring materials by various image forming apparatuses.

Even though the image erasing apparatus 100 according to the first embodiment recognizes the identification data that identifies the image forming apparatus which forms the image on the sheet based on the image data obtained by reading the image of the sheet, the identification data may be directly input by the user by operating the operation unit 128. In this case, the operation unit 128 also serves as an input unit which inputs the identification data of the image forming apparatus. Further, in the first embodiment, even though the identification data of the image forming apparatus is the data specific to the image forming apparatus, the data may be data on the kind of the coloring material. In this case, in the control table, data specific to the coloring material (a manufacturer's name, a model number, and a manufacturing number) is stored, instead of the data specific to the image forming apparatus.

Figure 5:
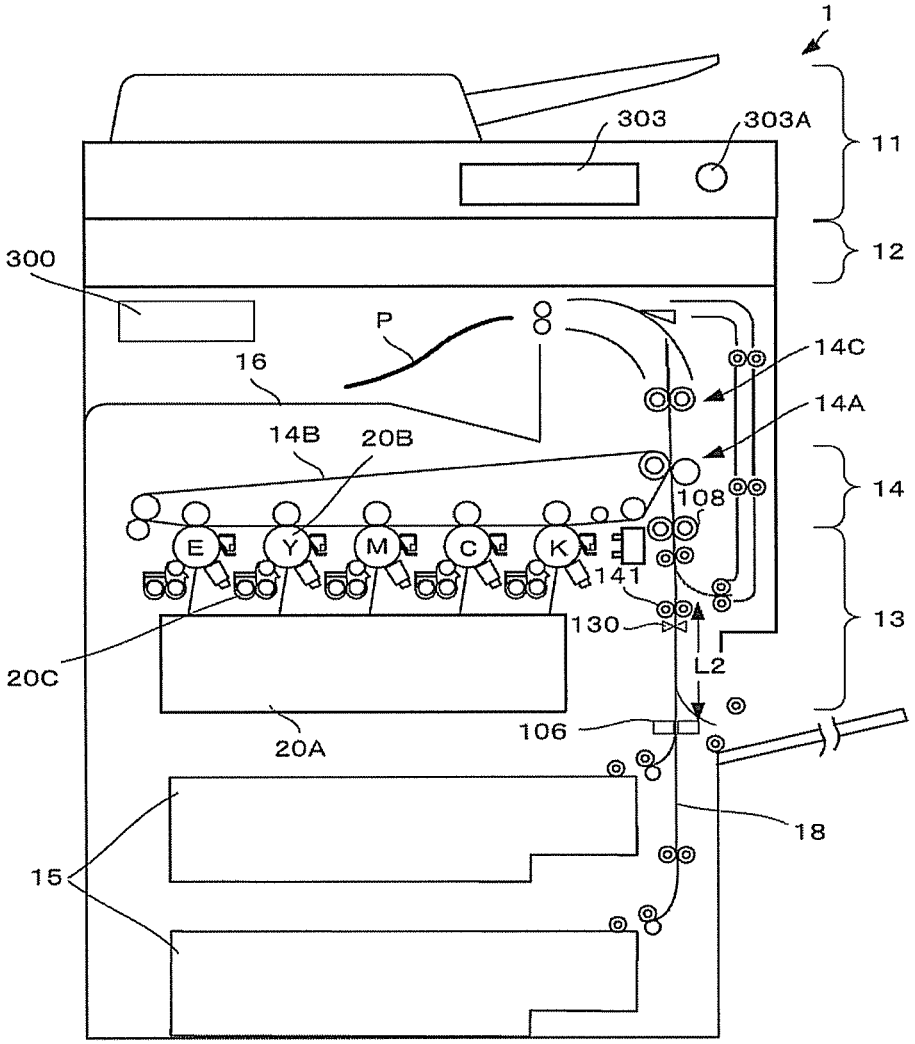
FIG. 5 is a cross-sectional view illustrating an image forming apparatus according to a second embodiment.

FIG. 5 illustrates an image forming apparatus according to a second embodiment. The image forming apparatus 1 has the same erasing function as the first embodiment. As illustrated in FIG. 5, the image forming apparatus 1 includes a control unit 300, an operation unit 303, a start button 303A, an automatic document feeding device 11, a scanner 12, an image forming unit 13, a transfer unit 14, a sheet conveyance mechanism 18, and a sheet feeding unit 15.

The operation unit 303, for example, has a touch panel which is an input/output unit which receives the operation of a user by a graphical user interface manner. The start button 303A receives a pressing operation by the user to output a signal indicating that the image forming starts to the control unit 300.

The automatic document feeding device 11 is provided on a top portion of a main body of the image forming apparatus 1 so as to be opened and closed. The automatic document feeding device 11 includes a document conveyance mechanism which ejects the document from the sheet feeding tray one by one and conveys the document to a discharge tray. The automatic document feeding device 11 conveys the document to a document reading part of the scanner 12 by the document conveyance mechanism one by one. It is also possible to open the automatic document feeding device 11 to load the document on a document table of the scanner 12.

The scanner 12 includes a carriage which includes an exposure lamp which exposes the document and a first reflection mirror, a plurality of second reflection mirrors which move in accordance with the movement of the carriage, a lens block, and a CCD (charge coupled device) serving as an image reading sensor. The carriage is stopped on the document reading part or reciprocates below the document table to reflect light reflected from the document onto the first reflection mirror. The plurality of second reflection mirrors reflects the light reflected from the first reflection mirror onto the lens block. The lens block changes a magnifying factor of the reflected light and projects the reflected light onto the CCD. The CCD converts the incident light into an electric signal to output the converted signal to the image forming unit 13 as an image signal.

The image forming unit 13 forms an image using a toner which is not erasable (normal toner) and an erasable toner as a coloring material. The toner which is not erasable is, for example, formed of a yellow toner Y, a magenta toner M, a cyan toner C, and a black toner K. The erasable toner is, for example, formed of a black toner E. The image forming unit 13 has a laser irradiating unit 20A and five process units 307 which include a photosensitive drum 20B which is an electrostatic latent image carrier, and a development unit 20C for each of four color toners Y, M, C, and K which are not erasable and the erasable toner E.

The erasable toner includes a coloration compound, a color developer, and a discoloration temperature regulator. The coloration compound may use, for example, a leuco dye. The color developer may use, for example, phenols. In case that the discoloration temperature regulator is heated, the discoloration temperature regulator is compatible with the coloration compound and uses a material which does not have affinity for the color developer. The color erasable toner forms a color by an interaction between the coloration compound and the color developer and the color of the color erasable toner is erased due to the broken interaction between the coloration compound and the color developer by being heated at the color erasing temperature or higher, or the color of the color erasable toner is erased to be transparent.

The laser irradiating unit 20A irradiates laser light onto the photosensitive drum 20B based on the image signal to form an electrostatic latent image on the photosensitive drum 20B. The image signal is formed by adding an image signal corresponding to the specific pattern described in the first embodiment to an image signal corresponding to a document image from the scanner 12. The development unit 20C supplies the toner to the photosensitive drum 20B and forms a toner image from the electrostatic latent image.

The sheet feeding unit 15 has an upper sheet feeding cassette and a low sheet feeding cassette. The sheet feeding unit 15 ejects the sheet from the upper sheet feeding cassette or the low sheet feeding cassette one by one to deliver the sheet to the sheet conveyance mechanism 18. The sheet conveyance mechanism 18 conveys the sheet to the transfer unit 14. For example, the upper sheet feeding cassette accommodates a sheet P1 on which an image is formed and the lower sheet feeding cassette accommodates a sheet P2 on which no image is formed or the image is erased.

The transfer unit 14 includes a transfer roller 14A and a transfer belt 14B. The transfer belt 14B which serves as an image carrier transfers the toner image onto a belt surface from the photosensitive drum 20B. The transfer belt 14B carries the transferred toner image to convey the toner image to a position of the transfer roller 14A. The transfer roller 14A transfers the toner image from the transfer belt 14B to the conveyed sheet by applying a voltage. The image forming apparatus 1 includes a fixing unit 14C positioned at a downstream of the sheet conveyance direction further than the transfer roller 14A. The fixing unit 14C heats and pressurizes the toner image to be fixed on the sheet. The sheet P after fixing the image is discharged from a discharging port to the discharge tray 16.

The image forming apparatus 1 includes an image erasing apparatus positioned at an upstream of the sheet conveyance direction further than the transfer roller 14A and a downstream of the sheet conveyance direction further than the sheet feeding unit 15. The image erasing apparatus includes the input unit 106, the registration sensor 130, the registration member 141, and the erasing unit 108, which is similar to the first embodiment. The input unit 106, the registration sensor 130, the registration member 141, and the erasing unit 108 are disposed along the sheet conveyance direction in this order.

The registration member 141 includes a drive roller and a driven roller which are disposed so as to be opposite to each other with a conveyance path therebetween. The registration member 141 has, for example, a stepping motor which drives the drive roller. The registration sensor 130 detects that the sheet enters the registration member 141. The control unit 300 drives the registration member 141 and makes the registration member 141 grasp the sheet for a predetermined rotating step of the stepping motor after the sheet turns on the registration sensor 130.

The control unit 300 determines whether the image is erasable from the sheet based on the reading result by the input unit 106. During a time T2 when the determination is performed, the control unit 300 suspends the sheet by the registration member 141. Specifically, in case that the control unit 300 determines that the sheet enters the registration member 141 to be grasped by the registration member 141 based on the output of the registration sensor 130, the control unit 300 stops the rotation of the drive roller of the registration member 141. A length L2 from the position of the input unit 106 to a position of a leading edge of the sheet which is suspended by the registration member 141 is larger than a maximum length of a sheet which may be processed by the image forming apparatus 1. In case that the length L2 is a length where a sheet conveying time is sufficiently longer than the time T2, the image forming apparatus 1 may not have the registration member 141.

The components of the image forming apparatus 1 operate in accordance with the processing mode selected in the operation unit 303 by the user. The image forming apparatus 1 has first to third processing modes. In the first processing mode, the image forming apparatus 1 forms an image on the sheet P2. In the second processing mode, the image forming apparatus 1 performs erasing process by the erasing unit 108 on the sheet P1 and forms the image on the sheet from which the image is erased. In the third processing mode, the image forming apparatus 1 performs the erasing process by the erasing unit 108 on the sheet P1 and discharges the sheet without forming the image. The above processing modes may be selected by the operation of the user in the operation unit 303.

Figure 6:
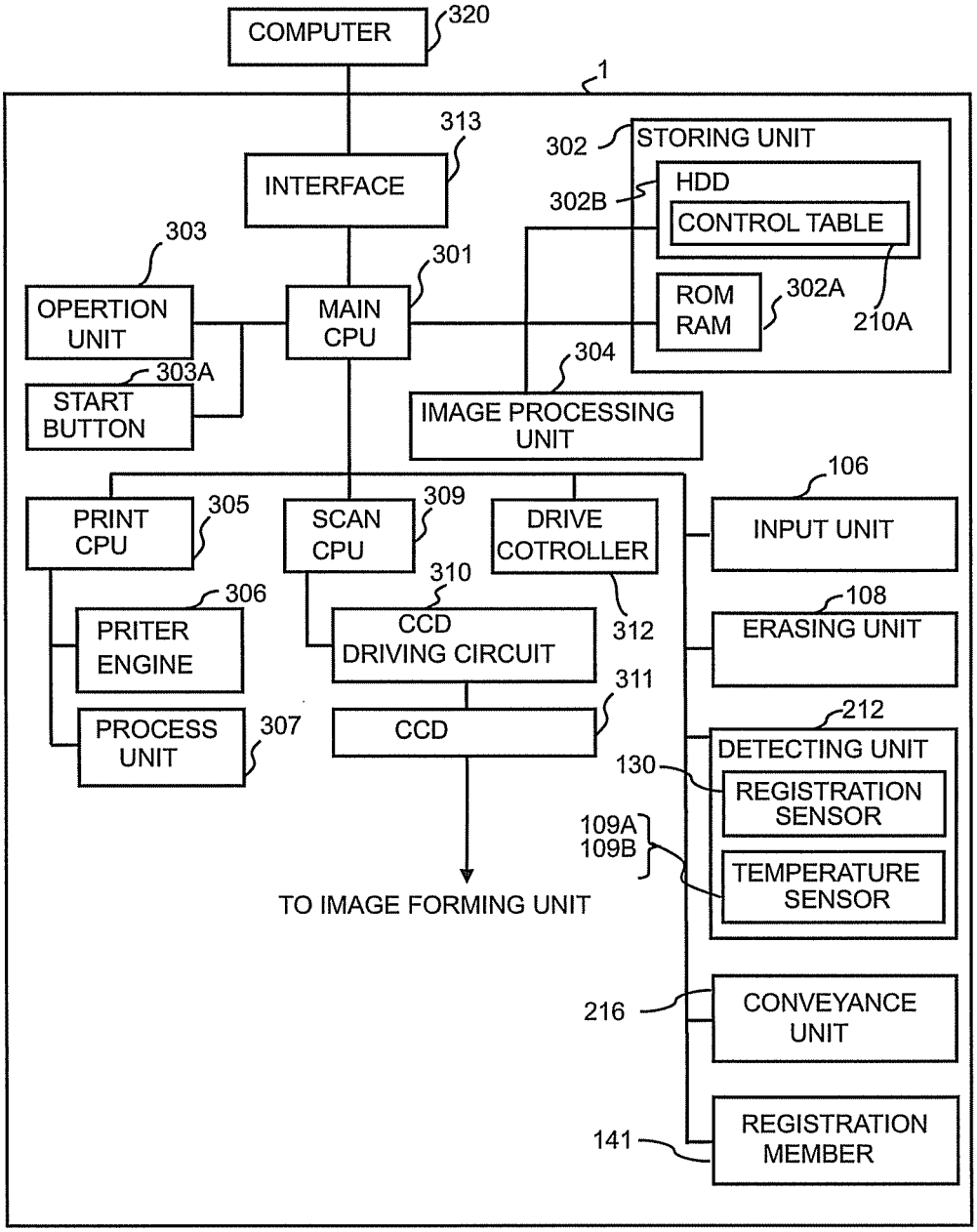
FIG. 6 is a block diagram illustrating a hardware configuration of the image forming apparatus according to the second embodiment.

FIG. 6 is a block diagram illustrating a hardware configuration of the image forming apparatus 1. As illustrated in FIG. 6, the image forming apparatus 1 includes a main CPU 301. The image forming apparatus 1 further includes a operation unit 303, a storing unit 302, a start button 303A, and an image processing unit 304 which performs image processing, which are connected to the main CPU 301. The main CPU 301 is an arithmetic device of the control unit 300 which totally controls the overall image forming apparatus 1. The main CPU 301 is connected to a computer 320 which is an external device via an interface 313. The main CPU 301 is connected to a print CPU 305, a scan CPU 309, and a drive controller 312.

The print CPU 305 controls each part of an image forming system based on the instruction of the main CPU 301. Specifically, the print CPU 305 controls a printer engine 306 which forms an electrostatic latent image on the photosensitive drum 20B and a process unit 307 which forms the toner image. The scan CPU 309 controls each part of an image reading system based on the instruction of the main CPU 301. Specifically, the scan CPU 309 controls a CCD driving circuit 310 which drives a CCD 211 of the scanner 12. The image signal from the CCD 311 is output to the image forming unit 13. The drive controller 312 controls a driving part of the image forming apparatus 1.

The main CPU 301 is further connected to the input unit 106, the erasing unit 108, the detecting unit 212, the conveyance unit 216, and the registration member 141. Hereinafter, the CPUs 301, 305, and 309 are collectively called as "control unit 300". The control unit 300 controls the components of the image forming apparatus 1 based on a signal from the detecting unit 212. The detecting unit 212 includes a registration sensor 130, heating roller temperature sensors 109A and 109B.

The control unit 300 detects temperatures of the first heating roller 108H and the second heating roller 108I using the heating roller temperature sensors 109A and 109B and controls the temperatures of the first heating roller 108H and the second heating roller 108I. The control unit 300 determines the position of the sheet using the registration sensor 130. The storing unit 302 has a memory (ROM and RAM) 302A and a hard disk drive (hereinafter, the hard disk drive is referred to as an HDD) 302B.

The ROM of the memory 302A stores various control programs. The ROM stores a printing ratio of the sheet as a threshold value for determining whether the sheet is reusable and a concentration threshold value for determining whether the image of the sheet is erased. The ROM further stores the image data of a specific pattern. The HDD 302B stores the control table 210A illustrated in FIG. 3. The storing unit 302 stores the image read by the input unit 106. The storing unit 302 stores the number of processed sheets on which the erasing processing is performed.

The control unit 300 controls the operation of the image forming apparatus 1 in accordance with the first to third processing modes selected by the user in the operation unit 303. For example, in case that the operation unit 303 receives the selection of the first processing mode by the user, the operation unit 303 outputs a operation signal corresponding to the first processing mode to the control unit 300. The control unit 300 controls the printer engine 306 and the process unit 307 to form the image on the sheet P2 and discharges the sheet P2 to the discharge tray 16.

In case that the operation unit 303 receives the selection of the second processing mode by the user, the operation unit 303 outputs a operation signal corresponding to the second processing mode to the control unit 300. The control unit 300 controls the input unit 106 and the erasing unit 108 to erase the image of the sheet P1. Further, the control unit 300 controls the printer engine 306 and the process unit 307 to form the image on the sheet P1 from which the image has been erased and discharges the sheet P1 to the discharge tray 16.

In case that the operation unit 303 receives the selection of the third processing mode by the user, the operation unit 303 outputs a operation signal corresponding to the third processing mode to the control unit 300. The control unit 300 controls the input unit and the erasing unit to erase the image of the sheet P1. Further, the control unit 300 controls the printer engine 306 and the process unit 307 to discharge the sheet P1 to the discharge tray 16 without forming the image on the sheet P1 from which the image has been erased.

In the first and second processing modes, the control unit 300 reads image data having the specific pattern from the memory 302A. The control unit 300 adds the image signal corresponding to the image data having the specific pattern to the image signal from the scanner 12 to output the image signal to the laser irradiating unit 20A. Further, in the second and third processing modes, the control unit 300 identifies an image forming apparatus which forms an image on the sheet, which is similar to the first embodiment. The control unit 300 searches the control table 210A to determine whether the image is erasable by the erasing unit 108, based on the identification result. In case that the image is erasable by the erasing unit 108, the control unit 300 allows the erasing unit 108 to operate under the erasing processing condition which is erasing temperature corresponding to the identified image forming apparatus. In case that the image is not erasable by the erasing unit 108, the control unit 300 does not operate the erasing unit 108.

Figure 7:
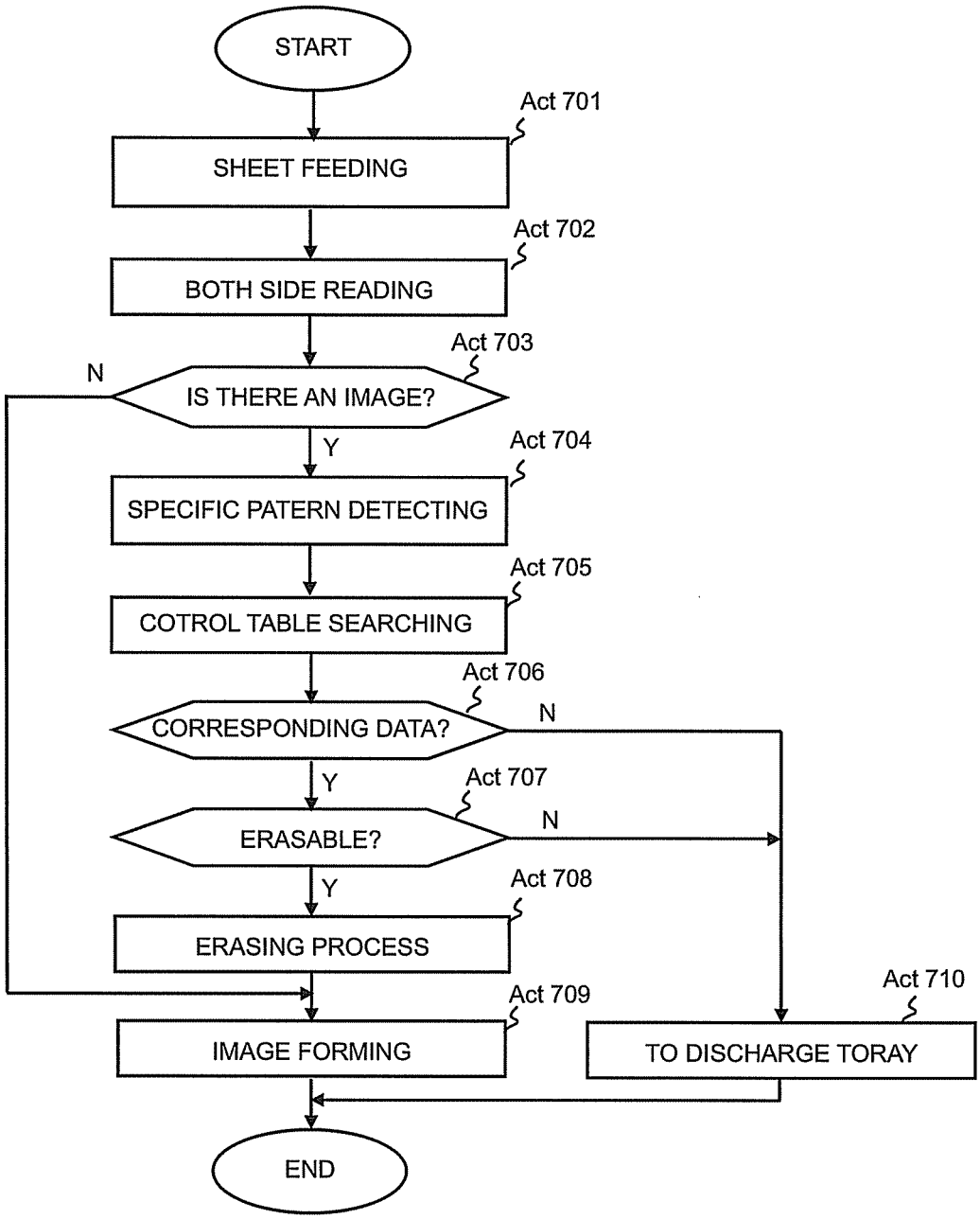
FIG. 7 is a flowchart illustrating an operation of the image forming apparatus according to the second exemplary embodiment.

FIG. 7 is a flowchart illustrating an operation of the image forming apparatus 1. As illustrated in FIG. 7, the image forming apparatus 1 identifies the image forming apparatus which forms the image on the sheet and erases the image of the sheet using the identification result and the control table 201A. For example, the operation unit 303 receives the selection of the second processing mode by the user. Further, in case that the operation unit 303 receives the operation of the start button 303A, in ACT 701, the image forming apparatus 1 feeds the sheet P1 from the upper sheet feeding cassette by the sheet feeding unit 15.

In Act 702, the control unit 300 allows the input unit 106 to read the image on both sides of the sheet P1 to store the input image data in the HDD 302B. In Act 703, the control unit 300 determines whether there is an image on the sheet P1, based on the image data. In case that the control unit 300 determines that there is an image on the sheet P1, the operation of the image forming apparatus 1 proceeds to Act 704. In case that the control unit 300 determines that there is no image on the sheet P2, the operation of the image forming apparatus 1 proceeds to Act 709. In Act 704, the control unit 300 detects the specific pattern from the input image data stored to recognize the identification data.

In Act 705, the control unit 300 searches the control table 210A based on the recognized identification data. In Act 706, the control unit 300 determines whether data corresponding to the recognized identification data is present in the control table 210A as a search result. In case that the control unit 300 determines that the specific data corresponding to the recognized identification data is present in the control table 210A, the operation of the image forming apparatus 1 proceeds to Act 707. In case that the control unit 300 determines that the specific data corresponding to the recognized identification data is not present in the control table 210A, the image is not erasable so that the operation of the image forming apparatus 1 proceeds to Act 710.

In Act 707, the control unit 300 reads the erasability data associated with the corresponding specific data from the control table 210A and determines whether the image of the sheet P1 is erasable, based on the erasability data. In case that the control unit 300 determines that the image of the sheet P1 is erasable, the operation of the image forming apparatus 1 proceeds to Act 708. In case that the control unit 300 determines that the image of the sheet P1 is not erasable, the operation of the image forming apparatus 1 proceeds to Act 710.

In Act 708, the control unit 300 reads the data of the erasing temperature associated with the corresponding specific data from the control table 210A and controls the temperature of the erasing unit 108 based on the erasing temperature to erase the image of the sheet P1. In Act 709, the image forming apparatus 1 conveys the sheet P1 which is subjected to the erasing process to the transfer unit 14 and forms the image on the sheet P1. The image forming apparatus 1 discharges the sheet P1 on which the image is formed to the discharge tray 16. In Act 710, the image forming apparatus 1 discharges the sheet P1 from which the image is not erasable to the discharge tray 16.

The above operation is performed when the second processing mode is selected by the user in the operation unit 303, but for example, when the first processing mode is selected by the user, the operation of the image forming apparatus 1 feeds the sheet P2 from the lower sheet feeding cassette by the sheet feeding unit 15 in ACT 701 and proceeds to Act 709 ignoring Act 702 to Act 708. In Act 709, the image forming apparatus 1 conveys the sheet P2 to the transfer unit 14 and forms the image on the sheet P2. The image forming apparatus 1 discharges the sheet P2 on which the image is formed to the discharge tray 16.

Further, for example, in case that the third processing mode is selected by the user, the operation of the image forming apparatus 1 proceeds to Act 709 after erasing the image of the sheet P1 in Act 708. In Act 709, the image forming apparatus 1 discharges the sheet P1 to the discharge tray 16 without forming the image on the sheet P1.

As described above, according to the image forming apparatus 1 according to the second embodiment, in the second processing mode and the third processing mode, the image forming apparatus which forms the image on the sheet is recognized to determine whether the image is erasable by the erasing unit 108. Further, in case that the image is erasable by the erasing unit 108, the erasing unit 108 operates under an erasing condition which is erasing temperature corresponding to the recognized image forming apparatus. Further, in case that the image is not erasable by the erasing unit 108, the erasing unit 108 does not operate and the sheet is discharged to the discharge tray 16. Accordingly, according to the image forming apparatus of the second embodiment, the erasing process may be performed on a sheet on which an image is formed by various coloring materials by various image forming apparatuses.

Further, according to the image forming apparatus 1 of the second embodiment, the image formed on the sheet is erased and an image is formed on the sheet from which the image has been erased. Even though the image forming apparatus 1 according to the second embodiment recognizes the identification data that identifies the image forming apparatus which forms the image on the sheet based on the image data obtained by reading the image of the sheet, the identification data may be directly input by the user by operating the operation unit. In this case, the operation unit also serves as an input unit which inputs the identification data of the image forming apparatus.

Further, in the second embodiment, even though the identification data of the image forming apparatus is the data specific to the image forming apparatus, the data may be data on the kind of the coloring material. In this case, in the control table, data specific to the coloring material (a manufacturer's name, a model number, a manufacturing number) is stored, instead of the data specific to the image forming apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing apparatus, comprising:

an erasing unit configured to erase an image formed on a recording medium by heating the image at an erasing temperature;

an input unit configured to read the image so as to obtain image data, the image data including an identification data for identifying an image forming apparatus which forms the image on the recording medium, before erasing the image by the erasing unit; and a control unit configured to recognize the identification data based on the obtained image data, determine the erasing temperature of the erasing unit based on the recognized identification data and control an operation of the erasing unit according to the determined erasing temperature.

2. The image erasing apparatus according to claim 1, wherein the control unit determines whether the image is erasable based on the recognized identification data.

3. The image erasing apparatus according to claim 1, further comprising:

a control table which stores data specific to a plurality of image forming apparatuses and the erasing temperature for controlling the erasing operation of the erasing unit so as to be associated with the specific data, wherein the control unit operates the erasing unit according to the erasing temperature corresponding to the specific data corresponding to the recognized identification data.

4. An image forming apparatus, comprising:

an image forming unit configured to form an image on a recording medium;

an erasing unit configured to erase an image formed on a recording medium by heating the image at an erasing temperature;

an input unit configured to read the image so as to obtain image data as the read result, the image data including an identification data for identifying an image forming apparatus which forms the image on the recording medium, before erasing the image by the erasing unit; and a control unit configured to recognize the identification data based on the obtained image data, determine the erasing temperature of the erasing unit based on the recognized identification data and control an operation of the erasing unit according to the determined erasing temperature.

5. The image forming apparatus according to claim 4, further comprising:

a control table which stores data specific to a plurality of image forming apparatuses and the erasing temperature for controlling the erasing operation of the erasing unit so as to be associated with the specific data, wherein the control unit operates the erasing unit according to the erasing temperature corresponding to the specific data corresponding to the recognized identification data.

* * * * *